US008054232B2

(12) United States Patent
Chiang et al.

(10) Patent No.: US 8,054,232 B2
(45) Date of Patent: Nov. 8, 2011

(54) ANTENNAS FOR WIRELESS ELECTRONIC DEVICES

(75) Inventors: Bing Chiang, Cupertino, CA (US); Douglas Blake Kough, San Jose, CA (US); Enrique Ayala Vazquez, Watsonville, CA (US); Eduardo Lopez Camacho, Watsonville, CA (US); Gregory Allen Springer, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/871,825

(22) Filed: Aug. 30, 2010

(65) Prior Publication Data

US 2010/0321249 A1 Dec. 23, 2010

Related U.S. Application Data

(62) Division of application No. 12/104,359, filed on Apr. 16, 2008, now Pat. No. 7,804,453.

(51) Int. Cl.
*H01Q 1/24* (2006.01)
*H01Q 1/48* (2006.01)

(52) U.S. Cl. ..... 343/702; 343/700 MS; 343/846

(58) Field of Classification Search ..... 343/700 MS, 343/702, 846

See application file for complete search history.

(56) References Cited

U.S. PATENT DOCUMENTS

| | | | | |
|---|---|---|---|---|
| 5,703,600 | A * | 12/1997 | Burrell et al. | 343/700 MS |
| 6,081,729 | A | 6/2000 | Bauerschmidt et al. | |
| 6,339,400 | B1 | 1/2002 | Flint et al. | |
| 6,380,930 | B1 | 4/2002 | Van Ruymbeke | |
| 6,621,466 | B2 * | 9/2003 | Kuck | 343/846 |
| 7,486,242 | B2 * | 2/2009 | Gala Gala et al. | 343/702 |
| 7,629,930 | B2 * | 12/2009 | Murch et al. | 343/700 MS |
| 7,688,276 | B2 * | 3/2010 | Quintero Illera et al. | 343/846 |
| 2002/0149523 | A1 | 10/2002 | Fang et al. | |
| 2004/0051670 | A1 | 3/2004 | Sato | |
| 2006/0244663 | A1 | 11/2006 | Fleck et al. | |
| 2007/0057855 | A1 | 3/2007 | Mizoguchi et al. | |
| 2007/0115187 | A1 | 5/2007 | Zhang et al. | |
| 2008/0018551 | A1 | 1/2008 | Cheng et al. | |
| 2009/0262029 | A1 | 10/2009 | Chiang et al. | |
| 2010/0060529 | A1 | 3/2010 | Schlub et al. | |
| 2010/0182205 | A1 | 7/2010 | Chiang | |

FOREIGN PATENT DOCUMENTS

| | | | |
|---|---|---|---|
| CN | 1256802 | A | 6/2000 |
| CN | 2850006 | Y | 12/2006 |
| EP | 1329979 | A1 | 7/2003 |
| EP | 1329985 | A1 | 7/2003 |
| WO | 99/36988 | | 7/1999 |

* cited by examiner

*Primary Examiner* — Hoang V Nguyen
(74) *Attorney, Agent, or Firm* — Treyz Law Group; David C. Kellogg; G. Victor Treyz

(57) ABSTRACT

Antenna window structures and antennas are provided for electronic devices. The electronic devices may be laptop computers or other devices that have conductive housings. Antenna windows can be formed from dielectric members. The dielectric members can have elastomeric properties. An antenna may be mounted inside a conductive housing beneath a dielectric member. The antenna can be formed from a parallel plate waveguide structure. The parallel plate waveguide structure may have a ground plate and a radiator plate and may have dielectric material between the ground and radiator plates. The ground plate can have a primary ground plate portion and a ground strip. The ground strip may reflect radio-frequency signals so that they travel through the dielectric member. The antenna may handle radio-frequency antenna signals in one or more communications bands. The radio-frequency antenna signals pass through the dielectric member.

6 Claims, 10 Drawing Sheets

ANTENNAS FOR WIRELESS ELECTRONIC DEVICES

This application is a division of patent application Ser. No. 12/104,359, filed Apr. 16, 2008, which is hereby incorporated by reference herein in its entirety.

BACKGROUND

This invention relates to antennas, and more particularly, to dielectric antenna windows that allow antennas to operate from within electronic devices such as laptop computers.

Due in part to their mobile nature, portable electronic devices are often provided with wireless communications capabilities. Portable electronic devices may use wireless communications to communicate with wireless base stations. For example, portable electronic devices such as laptop computers can communicate using the Wi-Fi® (IEEE 802.11) bands at 2.4 GHz and 5 GHz and the Bluetooth® band at 2.4 GHz. Communications are also possible in data service bands such as the 3G data communications band at 2100 MHz band (commonly referred to as UMTS or Universal Mobile Telecommunications System).

To satisfy consumer demand for small form factor wireless devices, manufacturers are continually striving to reduce the size of components that are used in these devices. For example, manufacturers have made attempts to miniaturize the antennas used in portable electronic devices.

A typical antenna may be fabricated by patterning a metal layer on a circuit board substrate or may be formed from a sheet of thin metal using a foil stamping process. These techniques can be used to produce antennas that fit within the tight confines of a compact portable device. With conventional portable electronic devices, however, design compromises are made to accommodate compact antennas. These design compromises can include, for example, compromises related to antenna efficiency and antenna bandwidth and comprises related to the visual appearance and structural integrity of the electronic devices.

It would therefore be desirable to be able to provide improved antennas for electronic devices such as portable electronic devices.

SUMMARY

Wireless communications structures for laptop computers or other electronic devices are provided. The wireless communications structures may include antennas and antenna window structures formed from dielectric members such as elastomeric spacers, as an example.

The electronic devices can have housings in which electrical components are mounted. The housings can be used, for example, to house components such as processors, memory, and input-output devices. Wireless transceiver circuitry, antennas, and other electrical components can be contained within a device housing.

The housing of a device may be formed from metal, metal alloys, or other conductive materials. An antenna may be housed within the housing. To allow radio-frequency antenna signals to pass through the conductive housing, an antenna window may be formed in the conductive housing.

The antenna windows can be formed from members such as dielectric spacers and dielectric gaskets, as an example. The antenna windows can be formed from materials with elastomeric properties in addition to dielectric properties. For example, the electronic device may be a laptop computer with two conductive housing portions that are hinged together and that open and close in a clamshell motion. In this type of arrangement, there may be one or more dielectric members (e.g., trim beads) along the perimeter (or along a portion of the perimeter) of at least one of the conductive housing portions. The dielectric members can be used to protect the laptop computer from damage when the laptop is closed (e.g., by preventing the two housing portions from directly contacting each other).

The antennas may be mounted inside the electronic device housing. For example, the antennas can be mounted beneath the dielectric members. The radio-frequency signals may be conveyed between the exterior of the electronic device housing and the antennas through the dielectric members. In embodiments in which the electronic devices are laptop computers with two housing portions that open and close in a clamshell motion, the dielectric members may convey radio-frequency signals between the exterior environment and the antennas even when the laptop computer is closed. The housing can form a channel that helps to guide these signals.

An antenna may be formed from one or more parallel plate waveguides, as an example. A parallel plate antenna structure of this type may have a ground plate and a radiator plate. The antenna can also have a reflector such as a copper sheet that serves to direct radio-frequency signals generated by the antenna towards the dielectric member. The gap between the ground plate and the radiator plate can be filled with a dielectric. The dielectric in the antenna may be selected to match the dielectric in the dielectric member so that radio-frequency signals pass between the antenna and the member with minimal reflection and attenuation.

The ground plate in the antenna can be split into multiple sections. In one example, the ground plate can be split into a primary ground plate portion and a ground strip. The ground strip may reflect radio-frequency signals generated by the antenna that are traveling away from the dielectric member. By reflecting signals that are traveling away from the member, the ground strip may increase antenna efficiency.

Further features of the invention, its nature and various advantages will be more apparent from the accompanying drawings and the following detailed description of the preferred embodiments.

DETAILED DESCRIPTION

The present invention relates generally to antennas, and more particularly, to antennas for wireless electronic devices such as laptop computers. The wireless electronic devices may have conductive housings and the antennas can be mounted inside the conductive housings. Antenna windows allow the antennas to transmit and receive radio-frequency signals from inside the conductive housings.

The wireless electronic devices can be any suitable electronic devices. As an example, the wireless electronic devices can be desktop computers or other computer equipment. The wireless electronic devices may also be portable electronic devices such as portable computers also known as laptop computers or small portable computers of the type that are sometimes referred to as ultraportables. Portable electronic devices may also be somewhat smaller devices. Examples of smaller portable electronic devices include personal accessory devices capable of being worn, carried, or otherwise attached to the body such as arm and wrist band devices, pendant devices, headphone and earpiece devices, and other wearable and miniature devices. In one embodiment, the portable electronic devices are handheld electronic devices.

Examples of portable and handheld electronic devices include laptop computers, cellular telephones, media players with wireless communications capabilities, handheld computers (also sometimes called personal digital assistants), remote controls, global positioning system (GPS) devices, and handheld gaming devices. The devices can also be hybrid devices that combine the functionality of multiple conventional devices. Examples of hybrid devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
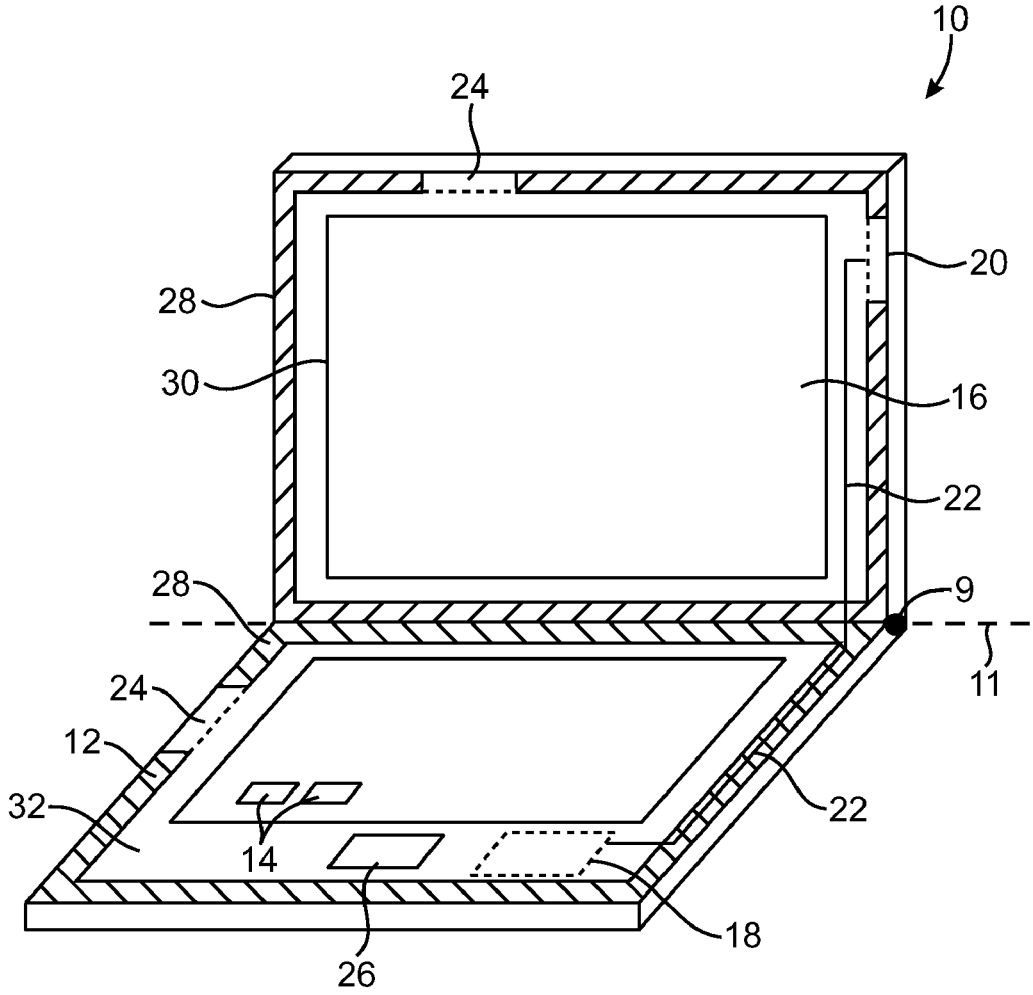
FIG. 1 is a perspective view of an illustrative electronic device such as a portable electronic device in accordance with an embodiment of the present invention.

An illustrative electronic device such as a portable electronic device in accordance with an embodiment of the present invention is shown in FIG. 1. Device 10 may be any suitable electronic device. As an example, device 10 can be a laptop computer.

Device 10 may handle communications over one or more communications bands. For example, wireless communications circuitry in device 10 may be used to handle cellular telephone communications in one or more frequency bands and data communications in one or more communications bands. Typical data communications bands that can be handled by the wireless communications circuitry in device 10 include the 2.4 GHz band that is sometimes used for Wi-Fi® (IEEE 802.11) and Bluetooth® communications, the 5 GHz band that is sometimes used for Wi-Fi® communications, the 1575 MHz Global Positioning System band, and 3G data bands (e.g., the UMTS band at 1920-2170). These bands can be covered by using single and multiband antennas. For example, cellular telephone communications can be handled using a multiband cellular telephone antenna and local area network data communications can be handled using a multiband wireless local area network antenna. As another example, device 10 can have a single multiband antenna for handling communications in two or more data bands (e.g., at 2.4 GHz and at 5 GHz).

Device 10 has housing 12. Housing 12, which is sometimes referred to as a case, can be formed of any suitable materials including plastic, glass, ceramics, metal, other suitable materials, or a combination of these materials. In embodiments in which device 10 is a laptop computer with top and bottom halves, housing halves such as housings 30 and 32 can together form housing 12. For example, housing portion 30 may be a top half of device 10 that houses a display such as display 16 and housing portion 32 may be a bottom half of device 10 that houses circuitry such as circuitry 18. The housing halves (e.g., housings 30 and 32) can be hinged using a hinge such as hinge 9. Hinged housing halves can open and close in a clamshell motion about hinge axis 11.

Housing 12 or portions of housing 12 may also be formed from conductive materials such as metal. An illustrative metal housing material that may be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc.

Device 10 can have an antenna window formed from portions of housing 12 and a dielectric such as a portion of a dielectric member (e.g., part of members 28). Members such as member 28 may also be referred to as gaskets. With one suitable arrangement, each member 28 can be a narrow bead of elastomeric material that lines a perimeter of housing 12. For example, as illustrated in FIG. 1, device 10 can be a laptop computer that has top and bottom housing portions (e.g., housing portion 30 and housing portion 32, respectively) and that opens and closes in a clamshell motion. Members such as member 28 may be provided on the inside face of one or both of the housing portions. This may help prevent the housing portions from contacting each other when the laptop computer is closed (e.g., by acting as a mechanical spacer between housing portion 30 and housing portion 32). By preventing the housing portions from coming into contact, members 28 can protect a display screen or other potentially fragile elements in the laptop computer from damage when the laptop computer. Members 28 may also help keep dust, water, and other debris from entering device 10 (e.g., by acting as a gasket). Members 28 or portions of a member 28 can be formed from dielectric materials such as rubber, epoxy, plastic, fiberglass-filled epoxy (e.g., flame retardant 4, FR4, or epoxy-fiberglass), thermoplastic polyurethane, etc. In arrangements in which members 28 are used as gaskets, the dielectric materials used to form member 28 or portions of member 28 preferably have elastomeric properties (e.g., as with soft rubber or plastic).

Members such as members 28 need not line the entire perimeter of housing 12. For example, a dielectric member on housing 12 may be formed from one or more strips of material on at least one of housing portions 30 and 32. In this example, the dielectric member may be a single strip of material at the front edge of device 10 (e.g., adjacent to touchpad 26). With another suitable arrangement, dielectric members may be formed from one strip along the right side of housing portion 30 (e.g., at the location of antenna 20 in FIG. 1) and one strip along the left side of housing portion 30 (e.g., on the side of housing 20 opposite antenna 20). Dielectric members can also be formed from smaller shapes such as small squares of elastomeric and/or dielectric material. For example, dielectric members 28 can be formed from squares of material located at the outside corners of device 10 (e.g., the two corners of housing portion 30 furthest from the hinge joint of a laptop computer).

Member 28 need not be used as a physical spacer. For example, member 28 can blend in with surrounding portions of device 10. In this type of arrangement, member 28 may not extend above the surface of housing 12 and can have an exterior appearance similar to surrounding portions of housing 12 (e.g., similar in texture and color).

Device 10 may have one or more keys such as keys 14. Keys 14 can be formed on any suitable surface of device 10. In the example of FIG. 1, keys 14 have been formed on the top surface of housing portion 32. With one suitable arrangement, keys 14 may form a keyboard on a laptop computer. Keys such as keys 14 may also be referred to as buttons.

If desired, device 10 may have a display such as display 16. Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality can be integrated into display 16. Device 10 can also have a separate touch pad device such as touch pad 26.

Device 10 can have circuitry 18. Circuitry 18 may include storage, processing circuitry, and input-output components. Wireless transceiver circuitry in circuitry 18 may be used to transmit and receive radio-frequency (RF) signals. Transmission lines (e.g., communications paths) such as coaxial transmission lines and microstrip transmission lines are used to convey radio-frequency signals between transceiver circuitry and antenna structures in device 10. As shown in FIG. 1, for example, transmission line 22 is used to convey signals between antenna structure 20 and circuitry 18. Communications path 22 (i.e., transmission line 22) can be, for example, a coaxial cable that is connected between an RF transceiver (sometimes called a radio) and a multiband antenna. Antenna structures such as antenna structure 20 may be located beneath a portion of member 28 adjacent to display 16 as shown in FIG. 1 or in other suitable locations. For example, antenna structures such as antenna structure 20 can be located adjacent to display 16 on the top edge of housing portion 30 or adjacent to keys 14 (e.g., on the side portion of housing portion 32) as illustrated by outlines 24.

Figure 2:
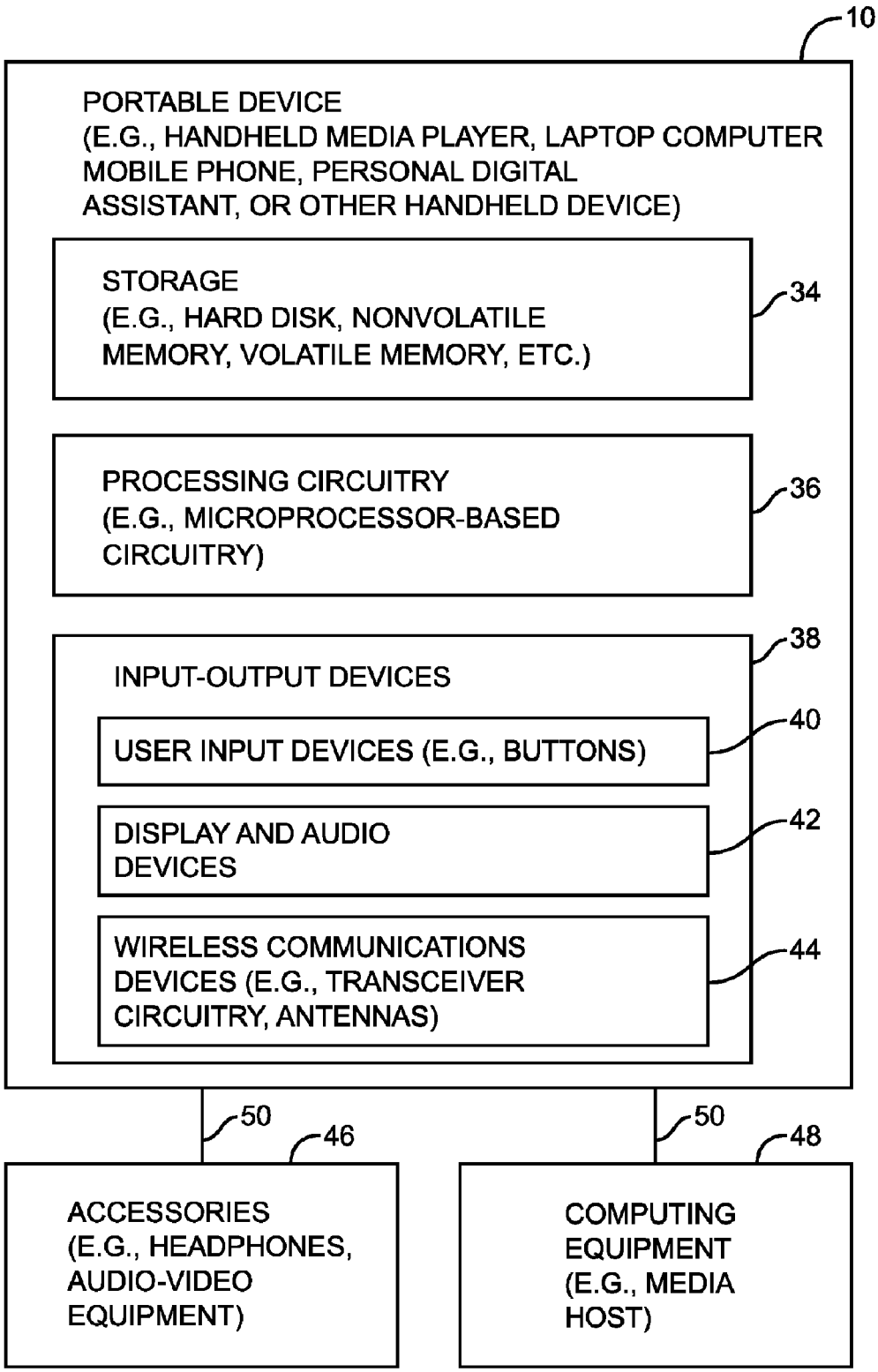
FIG. 2 is a schematic diagram of an illustrative electronic device in accordance with an embodiment of the present invention.

A schematic diagram of an embodiment of an illustrative electronic device such as a portable electronic device is shown in FIG. 2. Portable device 10 may be a laptop computer, a mobile telephone, a mobile telephone with media player capabilities, a handheld computer, a remote control, a game player, a global positioning system (GPS) device, a combination of such devices, or any other suitable portable or handheld electronic device.

As shown in FIG. 2, portable device 10 can include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 can be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 can be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3G data services, cellular telephone communications protocols, etc.

Input-output devices 38 may be used to allow data to be supplied to device 10 and to allow data to be provided from device 10 to external devices. Display screen 16, keys 14, and touchpad 26 of FIG. 1 are examples of input-output devices 38.

Input-output devices 38 can include user input-output devices 40 such as buttons, touch screens, joysticks, click wheels, scrolling wheels, touch pads, key pads, keyboards, microphones, cameras, speakers, tone generators, vibrating elements, etc. A user can control the operation of device 10 by supplying commands through user input devices 40.

Display and audio devices 42 can include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones, speakers, microphones, monitors, etc.

Wireless communications devices 44 can include communications circuitry such as radio-frequency (RF) transceiver circuitry formed from one or more integrated circuits, power amplifier circuitry, passive RF components, one or more antennas (e.g., antenna structures such as antenna structure 20 of FIG. 1), and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 can be any suitable computer. With one suitable arrangement, computing equipment 48 is a computer that has an associated wireless access point or an internal or external wireless card that establishes a wireless connection with device 10. The computer can be a server (e.g., an internet server), a local area network computer with or without internet access, a user's own personal computer, a peer device (e.g., another portable electronic device 10), or any other suitable computing equipment.

The antenna structures and wireless communications devices of device 10 can support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2100 MHz band (commonly referred to as UMTS or Universal Mobile Telecommunications System), Wi-Fi® (IEEE 802.11) bands (also sometimes referred to as wireless local area network or WLAN bands), the Bluetooth® band at 2.4 GHz, and the global positioning system (GPS) band at 1575 MHz. Wi-Fi® bands that can be supported include the 2.4 GHz band and the 5 GHz bands. The 2.4 GHz Wi-Fi® band extends from 2.412 to 2.484 GHz. Commonly-used channels in the 5 GHz Wi-Fi® band extend from 5.15-5.85 GHz, so the 5 GHz band is sometimes referred to by the 5.4 GHz approximate center frequency for this range (i.e., these communications frequencies are sometimes referred to as making up a 5.4 GHz communications band). Device 10 can cover these communications bands and/or other suitable communications bands with proper configuration of the antenna structures in wireless communications circuitry 44.

Figure 3:
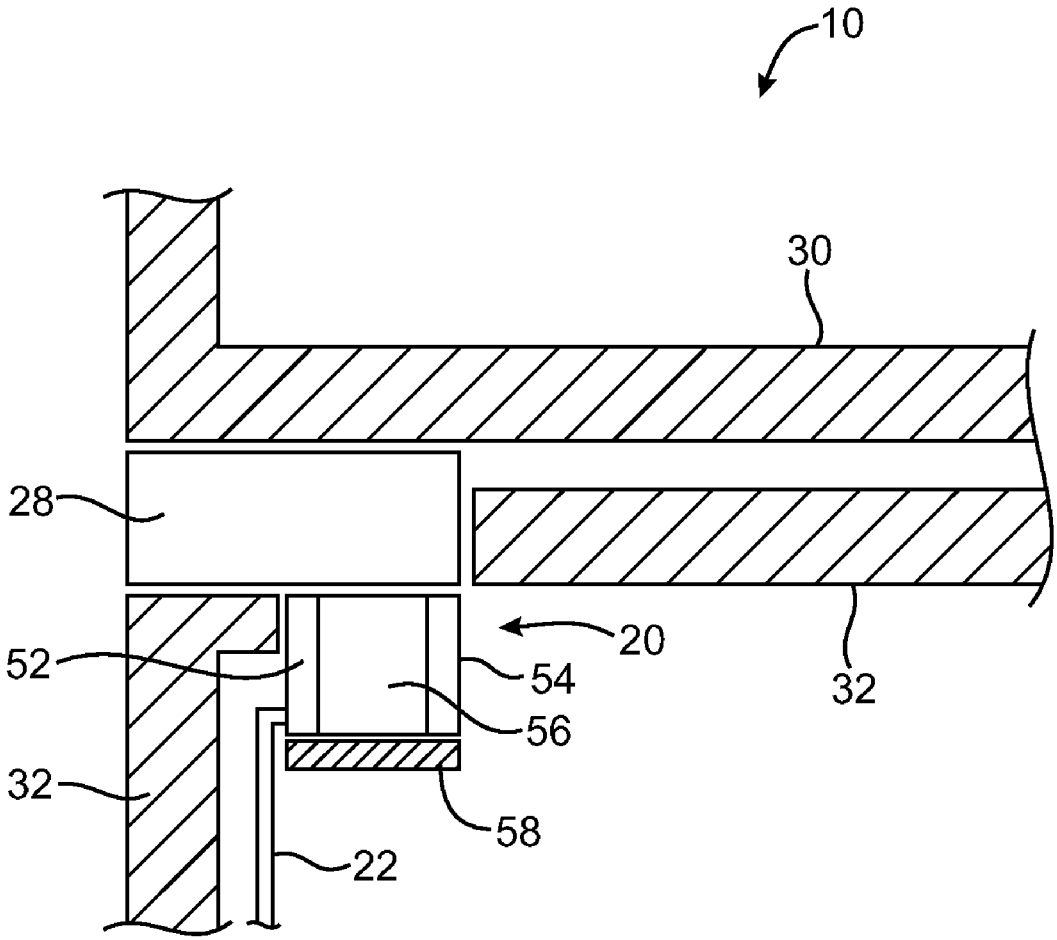
FIG. 3 is a side view of an illustrative antenna and a portion of an illustrative electronic device that has a dielectric member in accordance with an embodiment of the present invention.

A side view of an illustrative antenna structure and of a portion of an illustrative electronic device with a dielectric member is shown in FIG. 3. As shown in FIG. 3, antenna 20 can be formed inside housing 12. For example, antenna 20 can be formed inside a portion of device 10 such as lower housing portion 32. Member 28 may extend above a flat portion of housing 12. For example, as shown in FIG. 3, member 28 may extend above an upper planar surface associated with housing portion 32 to prevent housing portions 30 and 32 from coming into contact with each other.

In FIG. 3, member 28 is shown on only one portion of housing 12 (e.g., housing portion 32). This is merely an example. In general, member 28 can be formed on housing portion 30 or on housing portions 30 and 32 (e.g., the top and bottom portions, respectively, of an illustrative laptop computer).

As shown in FIG. 3, member 28 can help define a channel between conductive housing portions of device 10. This channel conveys radio-frequency signals from the exterior of device 10 to the interior of housing 12 (e.g., housing portion 30 or housing portion 32). The channel formed by member 28 can be substantially rectangular in shape, as an example. As shown in FIG. 3, member 28 (and the channel it forms) has an aspect ratio of approximately one to two (e.g., the length of member 28 in FIG. 3 is approximately twice its height). This is merely an example. In general, member 28 (and the channel it forms) may have any suitable aspect ratio such as one to one, one to two, one to three, more than one to three, etc. For satisfactory performance, member 28 (and the channel it forms) should generally have a depth (e.g., a dimension perpendicular to the page in the orientation of FIG. 4) that is at least one-half of a wavelength at the operating frequency of antenna 20 including the effects of the dielectric material used to form member 28. In one embodiment, conductive structures such as rivets or braces that are used to hold member 28 in place are spaced at least one-half of a wavelength apart so that member 28 has a depth of at least one-half of a wavelength that is substantially unobstructed by conductive structures.

Antenna 20 may be based on a parallel plate waveguide structure. For example, antenna 20 can be formed from a ground plate such as ground plate 52 and a radiator plate such as radiator plate 54. Ground plate 52 and radiator plate 54 can each have a substantially rectangular shape. Ground plate 52 and radiator plate 54 can be formed from any suitable conductive materials. With one suitable arrangement, plates 52 and 54 are formed primarily from copper. Antenna 20 can be fed by transmission line 22. In general, any suitable antenna design can be used for antenna 20. The use of a parallel plate arrangement is presented as an example.

Antenna 20, and in particular the space between ground plate 52 and radiator plate 54, may be filled with a dielectric insert such as dielectric 56. Dielectric 56 may be any suitable dielectric such as air, epoxy, polyimide, FR4, epoxy-fiberglass, etc.

Solid dielectrics 56 can serve to reduce the size of antenna 20 so that the antenna fits beneath dielectric member 28. For example, use of a printed circuit board dielectric may reduce the width (e.g., the separation between plates 52 and 54) of antenna 20 so that the antenna fits beneath a dielectric member that is similar in size to the spacers that are a part of a laptop computer (e.g., such as spacers for protecting a laptop computer that opens and closes in a clamshell motion). With one suitable arrangement, antenna 20 is small enough to be placed under a conventionally-sized spacer without modification to the spacer (e.g., without enlarging the conventionally-sized spacer or altering its exterior appearance). This may allow radio-communications capabilities to be added to an electronic device without modifying the exterior appearance of the device and without reducing the physical integrity of the device.

The dielectric properties of dielectric 56 and dielectric member 28 can be selected to enhance the operation of antenna 20. For example, by selecting appropriate dielectric materials for dielectric 56 and member 28, the efficiency of antenna 20 in transmitting and receiving radio-frequency signals to wireless communications equipment such as computing equipment 48 may be maximized. With one suitable arrangement, the dielectric materials in dielectric 56 may be similar to the dielectric materials in member 28 so that radio-frequency signals propagate between dielectric 56 and member 28 with little or no attenuation (e.g., little or no reflection at the interface between member 28 and dielectric 56).

Antenna 20 can be formed beneath a dielectric member such as member 28 so that the antenna is on the inside of device 10. An excessive gap between antenna 20 and member 28 might interfere somewhat with the operation of antenna 20 (e.g., by reducing transmission efficiency). For example, in situations in which there is a significant gap between antenna 20 and member 28, radio-frequency signals that propagate between member 28 and antenna 20 (e.g., dielectric 56) may be attenuated. It may therefore be desirable to mount antenna 20 beneath member 28 such that the gap between the antenna and the member is minimized.

A reflector such as reflector 58 can optionally be used to enhance the performance of antenna 20. Optional reflector 58 may be a sheet of copper or other conductor that is located beneath antenna 20 (as an example). Reflector 58 may improve the efficiency of antenna 20 by increasing the proportion of radio-frequency signals generated by antenna 20 that propagate out of device 10 through member 28 (e.g., instead of propagating into the interior of device 10).

Ground plate 52 and radiator plate 54 can be formed from a printed circuit board, a planar metal structure, conductive electrical components, other suitable conductive structures, or combinations of these structures.

Antenna 20 can be used to cover two communications bands. The first band may be (for example) the 2.4 GHz IEEE 802.11 "b" band and the second band may be (for example) the 5 GHz IEEE 802.11 "a" band (sometimes referred to by its approximate center frequency of 5.4 GHz). With another suitable arrangement, device 10 has more than one antenna 20 each of which covers one or more communications band. For example, device 10 may have a first antenna such as antenna 20 that covers the 802.11 "b" band and may have a second antenna such as antenna 20 that covers the 802.11 "a" band.

Any suitable feed arrangement can be used to feed antenna 20. As shown schematically in the example of FIG. 3, a transmission line such as transmission line 22 may be used to convey radio-frequency signals between antenna 20 and radio-frequency transceiver circuitry (wireless communications device 44 of FIG. 2). The transceiver circuitry can include one or more transceivers for handling communications in one or more discrete communications bands. The feed arrangement for antenna 20 can include a matching network. The matching network may include a balun (to match an unbalanced transmission line to a balanced antenna) and/or an impedance transformer (to help match the impedance of the transmission line to the impedance of the antenna).

Figure 4:
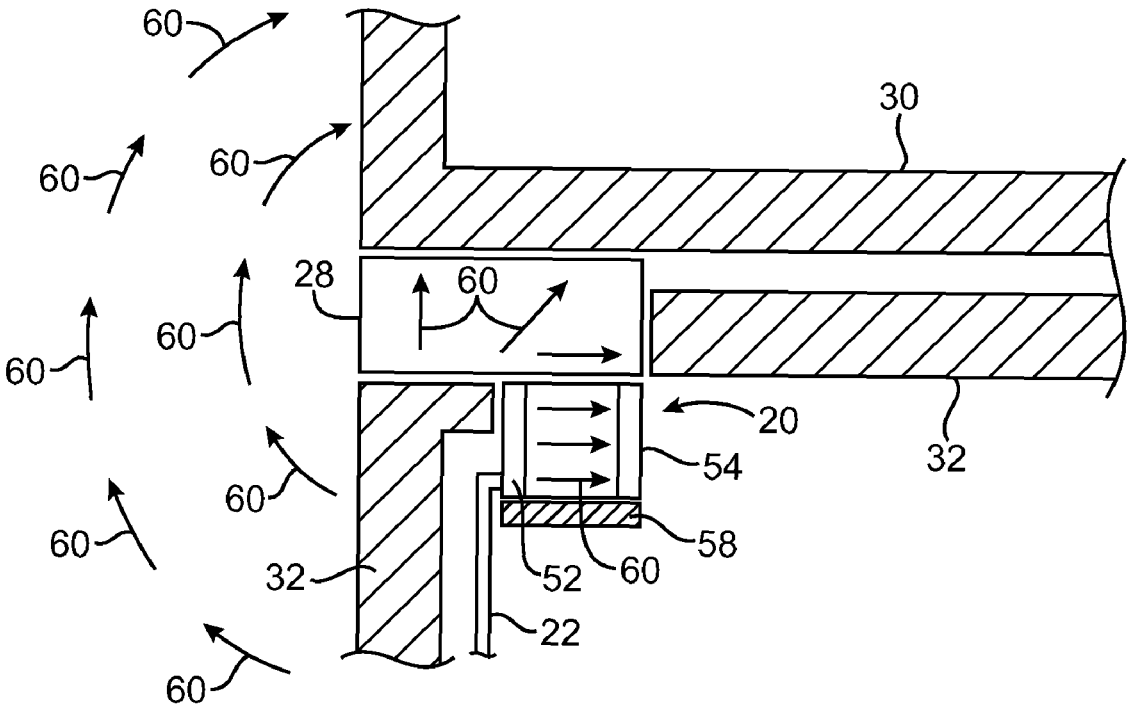
FIG. 4 is a side view of the illustrative antenna and the illustrative electronic device portion of FIG. 3 that shows illustrative electric fields that may be generated by the antenna in accordance with an embodiment of the present invention.

Illustrative electric fields that may be generated by antenna 20 are shown in FIG. 4. As shown in FIG. 4, antenna 20 may generate electric fields such as the electric fields illustrated by field lines 60. The electric fields illustrated in FIG. 4 may correspond to the electric field component of electromagnetic radiation (e.g., radio-frequency signals) that is generated by antenna 20 and that is received by antenna 20.

Antenna 20 may be oriented within device 10 such that electric field lines 60 pass through member 28 with a desired orientation. For example, antenna 20 can be mounted in device 10 such that the electric fields of the radio-frequency signals generated by antenna 20 are orientated across the narrow dimension of member 28. By orienting electric field lines 60 parallel to the narrow dimension (e.g., the vertical direction in FIG. 4) of member 28, the efficiency of antenna 20 can be improved relative to the efficiency of antenna 20 in situations in which field lines 60 are oriented perpendicular to the narrow dimension of member 28.

Member 28 can convey radio-frequency signals between antenna 20 and the exterior of device 10. When device 10 is a laptop computer that opens and closes in a clamshell motion, member 28 convey radio-frequency signals between antenna 20 and the exterior of device 10 both when the laptop computer is open (FIG. 1) and when the laptop computer is closed (e.g., as illustrated in FIG. 4).

Figure 5:
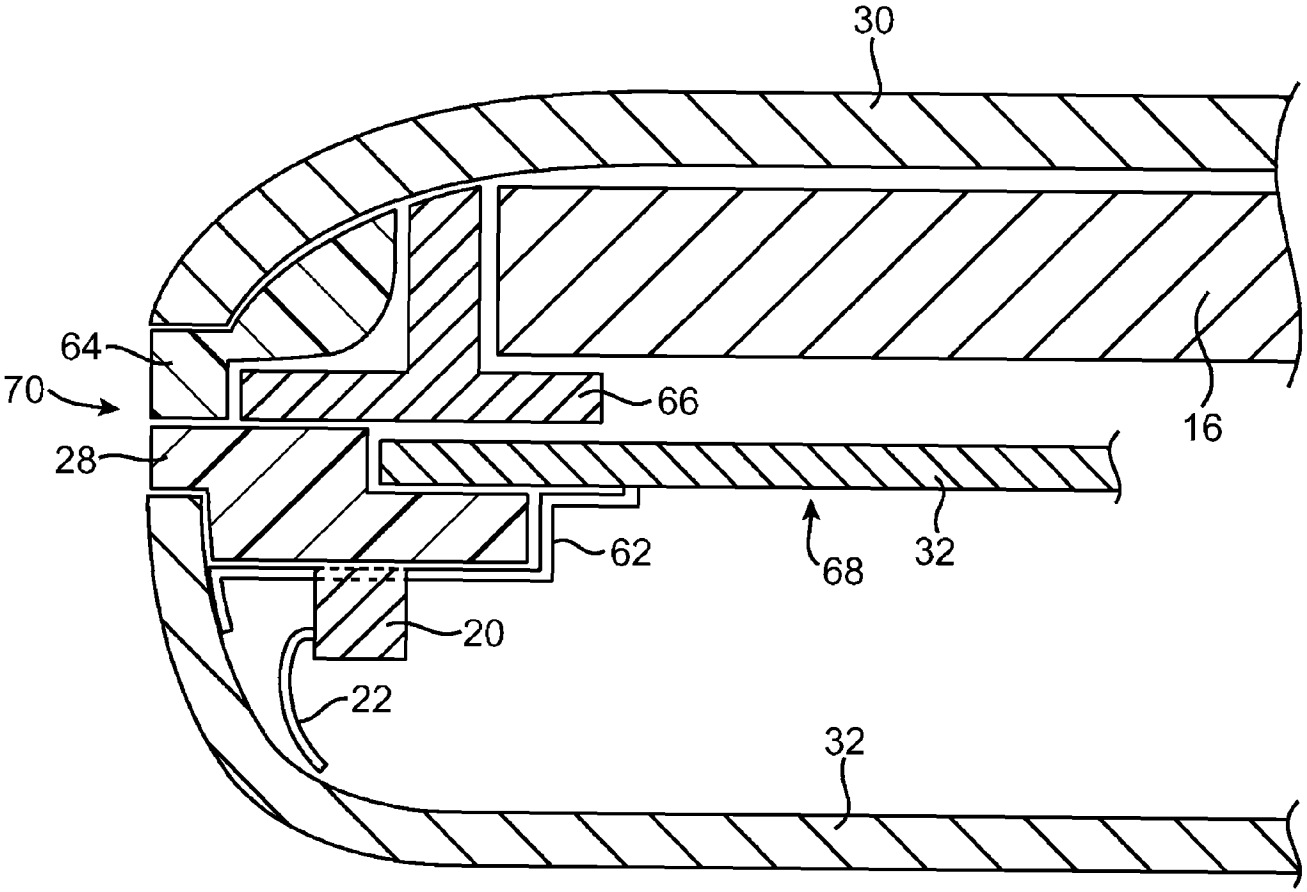
FIG. 5 is a side view of a portion of an illustrative electronic device that has a dielectric member, an upper housing portion, and a lower housing portion and of an illustrative antenna that is mounted in the lower housing portion in accordance with an embodiment of the present invention.

As illustrated in FIG. 5, device 10 can be a laptop computer with two housing portions such as housings 30 and 32. Housings 30 and 32 can be hinged and can open or close in a clamshell motion. There may be members such as members 28 and 64 in both housings 30 and 32. Members such as member 28 and 64 can be referred to as trim beads.

Housing portion 32 may contain a display such as display 16 that is held in place at least partly by member 66. Member 66 may be formed from materials similar to housing portion 30 or may be formed using other suitable conductive materials. Member 66 may be considered to be a part of housing portion 30. Member 66 may be referred to as a display frame (e.g., in arrangements in which member 66 at least partially surrounds a display such as display 16).

Member 66 and portions of housing portion 30 may together hold member 64 in place. Member 64 may be similar to member 28. For example, member 64 can act as a spacer that helps prevent housings 30 and 32 from coming into contact with other when the laptop (e.g., device 10) is closed. Member 64 can be formed from any suitable material such as the dielectric materials used to form member 28 or other suitable materials.

The top face of housing portion 32 (e.g., planar housing member 68) can be supported by member 62. Planar housing member 68 may also be referred to as a housing sub-top. Member 62 may be formed from materials similar to housing portion 30 or may be formed using other suitable conductive materials. Member 62 and other portions of housing portion 32 may be used in holding member 28 in place. For example, member 62 and other portions of housing portion 32 can substantially surround member 28 such that the member cannot be easily removed, as shown in FIG. 5.

Members such as members 62 and 66 can line the perimeter of housings 32 and 30, respectively. Alternatively, members 62 and 66 may only be located at certain points along the perimeter of housings 32 and 30. For example, members 62 and 66 can be located at discrete intervals along the perimeter of housings 30 and 32 or may be located at the corners of housings 30 and 32.

The members illustrated in FIG. 5 such as members 28 and 64 are merely illustrative examples. If desired, members 28 and 64 may be of similar shape and appearance or may fit together when housings 30 and 32 are brought together (e.g., as shown in FIG. 5).

Figure 6:
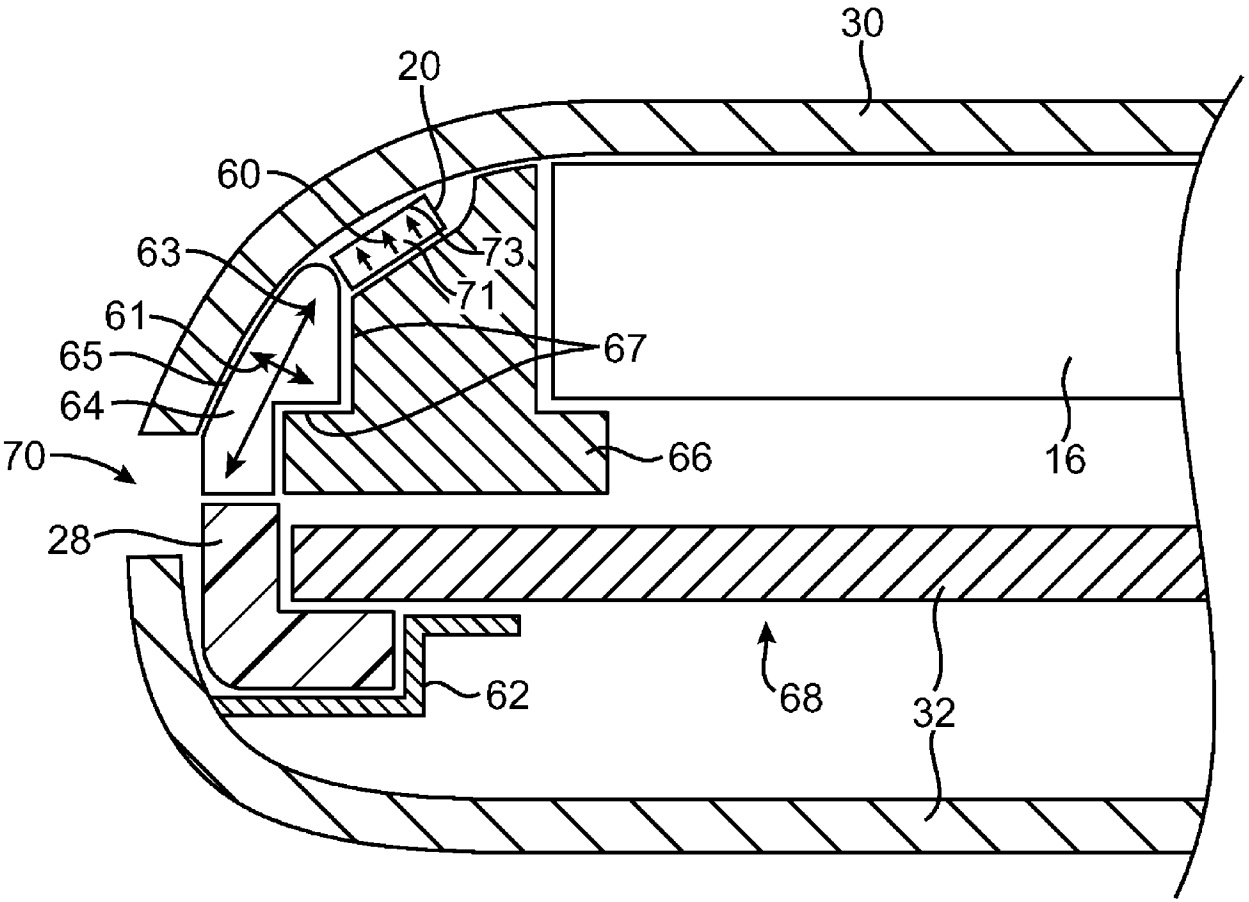
FIG. 6 is a side view of a portion of an illustrative electronic device that has a dielectric member, an upper housing portion, and a lower housing portion and of an illustrative antenna that is mounted in the upper housing portion in accordance with an embodiment of the present invention.

As illustrated in FIG. 6, antenna 20 may be located in housing portion 30 rather than housing portion 32. For example, antenna 20 can be located behind member 64 of upper housing portion 30 rather than underneath (or behind) member 28 as shown in FIG. 5. In this type of arrangement, member 64 can convey radio-frequency signals between antenna 20 and the exterior of device 10 in substantially the same manner as member 28 (e.g., as illustrated in FIG. 4). For example, member 64 can convey radio-frequency signals generated by antenna 20 to the exterior of device 10 through gap 70 between housings 30 and (e.g., when device 10 is a laptop in a closed position).

As shown in FIG. 6, member 64 defines a waveguide-like path for radio-frequency signals from antenna 20. The channel defined by this path has a narrow lateral dimension such as dimension 61 and a long longitudinal dimension such as dimension 63. The inner surfaces of the upper housing (i.e., inner surface 65 of upper housing portion 30 and opposing surface 67 of frame member 66) are roughly planar and form a waveguide path. By properly orienting antenna 20 so that the parallel plates are at locations 71 and 73, the electric field polarization of the radio-frequency signals from antenna 20 will be in a low-loss configuration (as shown in FIG. 6) in which electric fields 60 are oriented parallel to lateral dimension 61.

Members such as members 62 and 66 and housing portions such as housing portions 30 and 32 may be formed using any suitable materials. With one suitable arrangement, members such as members 62 and 66 and housing portions such as housing portions 30 and 32 are formed from conductive materials so that the inner surfaces that form the waveguide-like path (i.e., surfaces 65 and 67) are conductive and the radio-frequency signals pass through the waveguide-like path with minimal attenuation. With another suitable arrangement, members such as members 62 and 66 and housing portions such as housing portions 30 and 32 may be formed from non-conductive materials such as plastic that are coated with conductive materials (e.g., metal) at least along the inner surfaces that form the waveguide-like path (i.e., surfaces 65 and 67).

Figure 7:
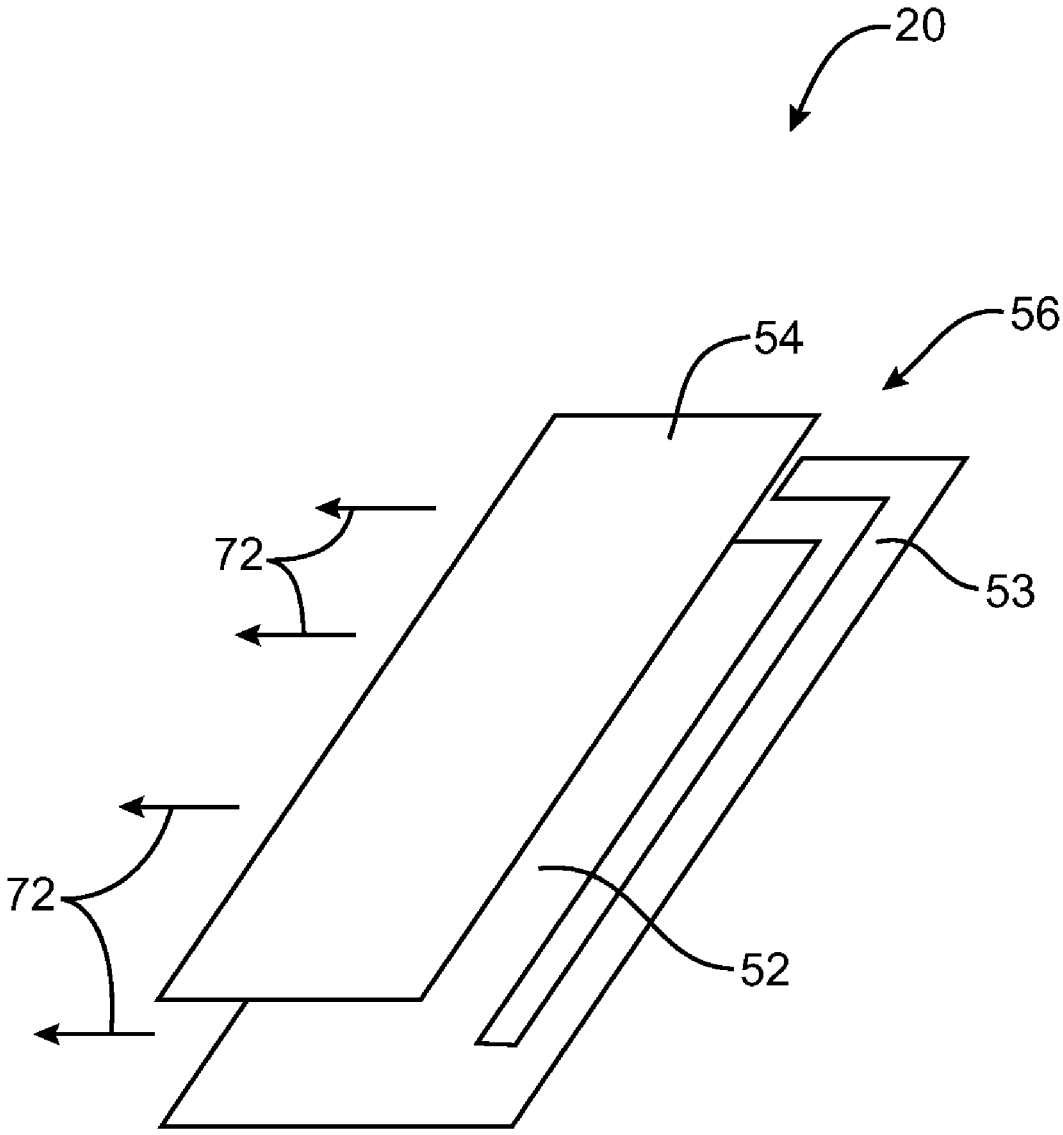
FIG. 7 is a perspective schematic view of an illustrative antenna that has a ground strip that serves as a reflector in accordance with an embodiment of the present invention.

A perspective view of antenna 20 is shown in FIG. 7. Antenna 20 may be formed from ground plate 52 and radiator plate 54. The space between plates 52 and 54 may be filled with dielectric 56.

FIG. 7 illustrates that ground plate 52 can be separated into a primary ground plate section (indicated by line 52) and a ground strip such as ground strip 53. Ground strip 53 can be provided to improve the efficiency of antenna 20. For example, ground strip 53 can improve the efficiency of antenna 20 by increasing the proportion of radio-frequency signals generated by antenna 20 that travel in the direction indicated by arrows 72 (rather than in the opposite direction). Ground strip 53 may serve as a near field reflector that reflects signals traveling in the direction opposite to arrows 72 so that they travel in the direction of arrows 72. Ground plates with a ground strip such as strip 53 are merely illustrative. If desired, other reflector structures may be used (e.g., a planar reflector) and more than two branches of ground plate 52 can be used (e.g., multiple ground strips can be used).

The length of ground strips such as ground strip 53 can be adjusted to enhance the performance of antenna 20. For example, the length of ground strip 53 may be adjusted such that the radio-frequency signals that reflect off of the ground strip have a phase that is suitable for directing those signals in the direction of arrows 72 and into members such as member 28 and 64.

With one suitable arrangement, antenna 20 can be mounted to a dielectric member such as member 28 or member 64 such that the dielectric member is on the same side of antenna 20 as arrows 72 in FIG. 7. When member 28 (or member 64) is located on the same side of antenna 20 as arrows 72, the efficiency of antenna 20 will be increased, because ground strip 53 directs radio-frequency signals in the direction of arrows 72.

Figure 8:
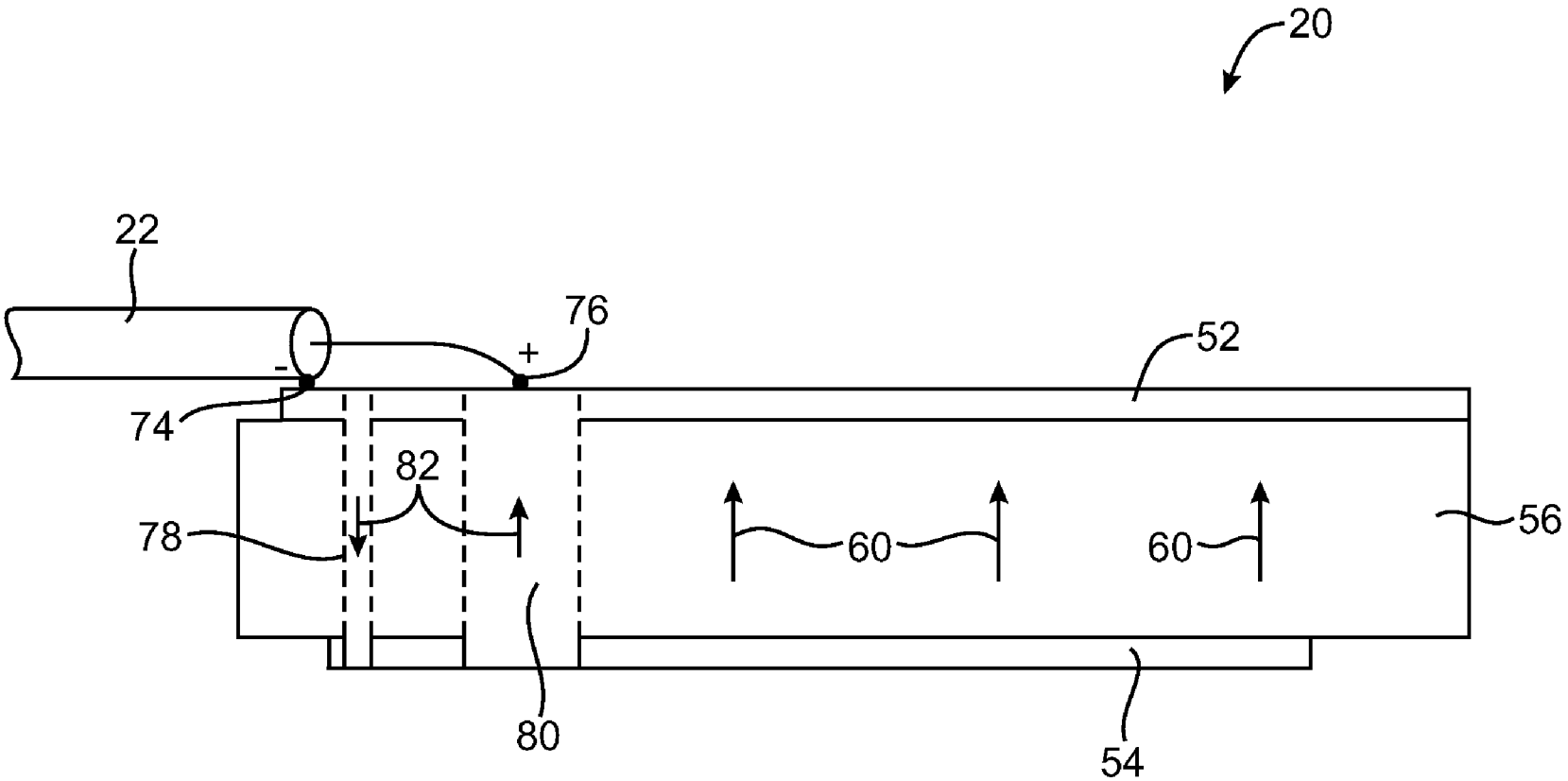
FIG. 8 is a side view of an illustrative antenna that may be used in an illustrative electronic device with a dielectric member in accordance with an embodiment of the present invention.

A side view of antenna 20 of FIG. 7 is shown in FIG. 8. As illustrated by FIG. 8, antenna 20 may be substantially rectangular in shape. Radiator plate 54 is shown as being shorter in length than ground plate 52. This is merely an example. Antenna 20 can be configured such that the electric fields of the radio-frequency signals generated by the antenna are oriented parallel to lines 60.

The thickness of antenna 20 (e.g., the distance between plates 52 and 54) may be approximately 3 millimeters, as an example.

Transmission line 22 may be coupled to antenna 20 at feed terminals such as feed terminals 74 and 76. Feed terminal 74 may be referred to as a ground or negative feed terminal and can be shorted to the outer (ground) conductor of transmission line 22. Feed terminal 76 may be referred to as the positive antenna terminal. A center conductor to transmission line 22 can connect to positive feed terminal 76. If desired, other types of antenna coupling arrangements may be used (e.g., based on near-field coupling, using impedance matching networks, etc.). The schematic feed arrangement of FIG. 8 is merely illustrative.

Feed via 80 can convey signals between positive feed terminal 76 (that is itself coupled to a center conductor in line 22) and radiator plate 54. Conductive short circuit vias 78 and feed via 80 may be electrically coupled to feed terminals 74 and 76, respectively. Vias 78 and 80 can be solder-filled vias (e.g., solder-filled holes in dielectric 56).

When antenna 20 is being used to transmit or receive radio-frequency communications signals, currents may flow through vias 78 and 80. Illustrative currents in vias 78 and 80 at a given point in time are shown by lines 82 in FIG. 8. With one suitable arrangement, the currents illustrated by line 82 may be the primary mechanism by which antenna 20 generates radio-frequency signals.

Figure 9:
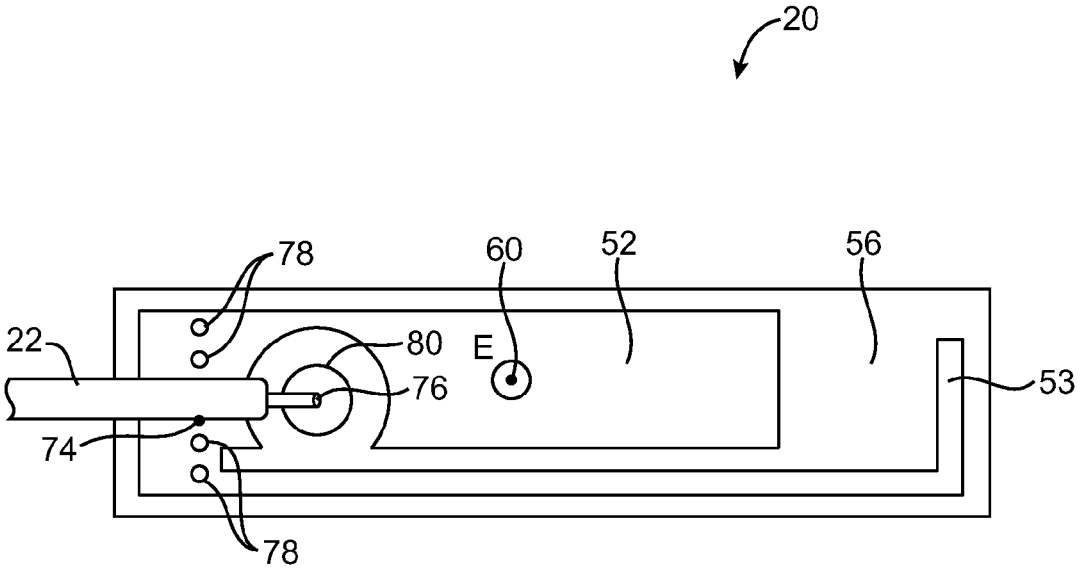
FIG. 9 is a top view of the illustrative antenna shown in FIG. 8 in accordance with an embodiment of the present invention.

A top view of antenna 20 is shown in FIG. 9 (e.g., looking down on ground plate 52). From the perspective of FIG. 9, the electric fields are oriented vertically as illustrated by line 60. FIG. 9 shows ground strip 53 (of FIG. 7) from a straight-on perspective. As illustrated in FIG. 9, multiple vias 78 may be spread across the width of ground plate 52 to reduce the resistance of this path. The width of antenna 20 (which is approximately the width of plate 52) can be 4 millimeters, as an example.

Figure 10:
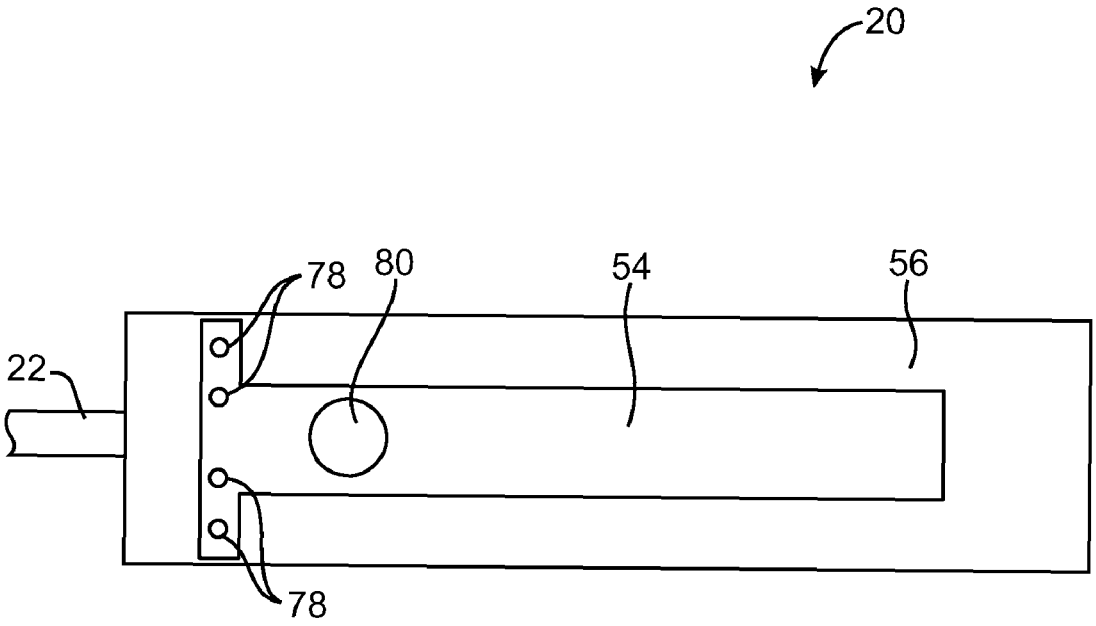
FIG. 10 is a bottom view the illustrative antenna shown in FIG. 8 in accordance with an embodiment of the present invention.

A bottom view of antenna 20 is shown in FIG. 10. As shown in FIG. 10, radiator plate 54 may be substantially rectangular in shape with a narrow elongated portion that extends most of the length of antenna 20 and a wide shortened portion surrounding and connected to vias 78.

The length of the narrow elongated portion of radiator plate 54 (e.g., the portion of plate 54 from via 80 to the portion of plate 54 opposite vias 78) may be related to the resonant frequency of antenna 20. For example, the length of the elongated portion of plate 54 can be approximately one-quarter of a wavelength at the resonant frequency of antenna 20 including the effects of dielectric 56.

The width of the elongated narrow portion of plate 54 may be related to the bandwidth of antenna 20. With one suitable arrangement, the bandwidth of antenna 20 may be increased by increasing the width of radiator plate 54, and in particular by increasing the width of the elongated narrow portion of radiator plate 54.

Any suitable dielectric material can be used to form dielectric portions of device 10 such as dielectric 56 and members 28 and 64. For example, dielectric portions of device 10 may be formed using a solid dielectric, a porous dielectric, a foam dielectric, a gelatinous dielectric (e.g., a coagulated or viscous liquid), a dielectric with grooves, pores, having a matrix structure, a dielectric having a honeycombed, or lattice structure or having other structural voids, a combination of such dielectrics, etc. Dielectrics such as dielectric 56 can also be formed using a gaseous dielectric. In one embodiment, dielectric portions of device 10 are formed with a nongaseous dielectric (e.g., a dielectric that is not air or another gas). If desired, the dielectric used in dielectric portions of device 10 (e.g., dielectric 56 and members 28 and 64) can form a honeycomb structure, a structure with grooved voids, spherical voids, or other hollow shapes. If desired, the dielectric portions of device 10 can be formed from epoxy, epoxy with hollow microspheres or other void-forming structures, etc. Porous dielectric materials used in device 10 can be formed with a closed cell structure (e.g., with isolated voids) or with an open cell structure (e.g., a fibrous structure with interconnected voids). Foams such as foaming glues (e.g., polyurethane adhesive), pieces of expanded polystyrene foam, extruded polystyrene foam, foam rubber, or other manufactured foams can also be used in device 10. If desired, the dielectric materials in device 10 can include layers or mixtures of different substances such as mixtures including small bodies of lower density material.

The foregoing is merely illustrative of the principles of this invention and various modifications can be made by those skilled in the art without departing from the scope and spirit of the invention.

What is claimed is:

1. A parallel plate waveguide antenna comprising:

a radiator plate;

a ground plate, wherein the ground plate includes a ground strip that reflects radio-frequency signals generated by the antenna; and a solid dielectric between the radiator plate and the ground plate, wherein the parallel plate waveguide antenna is mounted inside a conductive case of a laptop computer and wherein the solid dielectric comprises epoxy-fiberglass.

2. The parallel plate waveguide antenna defined in claim 1 wherein the laptop computer comprises a dielectric member mounted in the conductive case, wherein the parallel plate waveguide antenna in mounted inside the conductive case adjacent to the dielectric member, and wherein the dielectric member comprises portions that define a path for antenna signals between an exterior edge of the conductive case and the inside of the conductive case.

3. The parallel plate waveguide antenna defined in claim 2 wherein the radiator plate comprises a first side of a printed circuit board and wherein the ground plate comprises a second side of the printed circuit board.

4. The parallel plate waveguide antenna defined in claim 3 further comprising:

a first via that carries radio-frequency signals through the printed circuit board to the radiator plate; and a plurality of vias each of which has a smaller diameter than the first via and that electrically couple the radiator plate to the ground plate.

5. The parallel plate waveguide antenna defined in claim 4 further comprising a planar reflector that is perpendicular to both the radiator plate and the ground plate and that reflects radio-frequency signals along the path.

6. A parallel plate waveguide antenna comprising:

a radiator plate;

a ground plate, wherein the ground plate includes a ground strip that reflects radio-frequency signals generated by the antenna; and a solid dielectric between the radiator plate and the ground plate, wherein the ground strip and the ground plate lie in a common plane and wherein radio-frequency signals that have been reflected by the ground strip travel in a direction approximately parallel to the common plane.

* * * * *

UNITED STATES PATENT AND TRADEMARK OFFICE

CERTIFICATE OF CORRECTION

PATENT NO. : 8,054,232 B2
APPLICATION NO. : 12/871825
DATED : November 8, 2011
INVENTOR(S) : Bing Chiang et al.

It is certified that error appears in the above-identified patent and that said Letters Patent is hereby corrected as shown below:

In column 12 line 61, delete "waveguide antenna in mounted inside the conductive case" and insert -- waveguide antenna is mounted inside the conductive case --

Signed and Sealed this
Nineteenth Day of March, 2013

Teresa Stanek Rea
*Acting Director of the United States Patent and Trademark Office*